US006615851B2

(12) United States Patent
Scholz

(10) Patent No.: US 6,615,851 B2
(45) Date of Patent: Sep. 9, 2003

(54) STORAGE VESSEL FOR LIQUID HIGH-PURITY SUBSTANCES

(75) Inventor: Christoph Scholz, Waakirchen (DE)

(73) Assignee: CS Clean Systems Inc., Fremont, CA (US)

( * ) Notice: Subject to any disclaimer, the term of this patent is extended or adjusted under 35 U.S.C. 154(b) by 0 days.

(21) Appl. No.: 09/837,631

(22) Filed: Apr. 18, 2001

(65) Prior Publication Data

US 2002/0153031 A1 Oct. 24, 2002

(51) Int. Cl.[7] ..... B08B 3/04

(52) U.S. Cl. ..... 134/104.1; 134/169 C; 134/169 R; 134/166 R

(58) Field of Search ..... 134/166 C, 169 C, 134/168 C, 166 R, 104.1, 169 R; 141/89, 41

(56) References Cited

U.S. PATENT DOCUMENTS

| | | | | |
|---|---|---|---|---|
| 4,723,967 | A | | 2/1988 | Tom |
| 5,038,840 | A | * | 8/1991 | Fair |
| 5,069,244 | A | * | 12/1991 | Miyazaki et al. |
| 5,108,015 | A | | 4/1992 | Rauworth et al. |
| 5,279,338 | A | * | 1/1994 | Goossens |
| 5,330,072 | A | * | 7/1994 | Ferri, Jr. et al. |
| 5,447,640 | A | * | 9/1995 | Omi et al. |
| 5,589,005 | A | * | 12/1996 | Ohmi |
| 5,607,002 | A | * | 3/1997 | Siegele et al. |
| 5,671,591 | A | * | 9/1997 | Fleenor |
| 5,720,869 | A | * | 2/1998 | Yamanaka et al. |
| 5,878,793 | A | * | 3/1999 | Siegele et al. |
| 5,964,254 | A | * | 10/1999 | Jackson |
| 6,001,238 | A | * | 12/1999 | Takayasu et al. |
| 6,435,224 | B2 | * | 8/2002 | Blatt et al. |

FOREIGN PATENT DOCUMENTS

| | | |
|---|---|---|
| EP | 548 570 | 6/1993 |
| EP | 926 094 | 6/1999 |
| JP | 63-264199 | * 11/1988 |
| JP | 2-270322 | * 11/1990 |
| JP | 6-163502 | * 6/1994 |
| JP | 9-195079 | * 7/1997 |
| JP | 9-276672 | * 10/1997 |

* cited by examiner

*Primary Examiner*—Frankie L. Stinson
(74) *Attorney, Agent, or Firm*—Flynn, Thiel, Boutell & Tanis, P.C.

(57) ABSTRACT

A storage vessel (1) for liquid substances which are supplied to a consumer is provided with a device for cleaning the connecting pieces (7, 8, 13, 18) when the storage vessel (1) is changed, the storage vessel (1) having a connecting piece (13) provided with a shut-off device (15) and a coupling (16) for connection to a connecting piece (7) provided with a coupling (10) to a pressure gas line (3) with a shut-off device (5). The storage vessel (1) has a connecting piece (18) provided with a shut-off device (19) and a coupling (21) for connecting a discharge line (17) in the storage vessel (1) to a connecting piece (8) provided with a coupling (11) and a shut-off device (6) for supplying the substance subjected to the pressure gas in the vessel (1) to the consumer. A solvent vessel (23) for flushing the connecting pieces (7, 8, 13, 18), a vessel (28) for spent solvent which is evacuated in order to suck solvent into the connecting pieces (7, 8, 13, 18) as a vacuum source form a package (30) with the storage vessel (1).

14 Claims, 3 Drawing Sheets

STORAGE VESSEL FOR LIQUID HIGH-PURITY SUBSTANCES

FIELD OF THE INVENTION

This invention relates to a storage vessel for liquid substances which are supplied to an end-user device, having a device for cleaning the connecting pieces and lines when the storage vessel is changed.

BACKGROUND OF THE INVENTION

A storage vessel is used to supply liquid substances to a reactor for chemical vapor deposition (CVD). Such CVD reactors are used to produce chips, i.e. integrated microcircuits, and similar elements. In addition, e.g. devices for producing hard-material layers or glass fibers must be provided with liquid chemicals. To meet the constantly rising demands of such equipment, one must use extremely high-purity substances for the corresponding processes.

When the storage vessel containing the substance which is supplied to the device is replaced, however, there is a danger of impurities arising in the lines from the storage vessel to the reactors, in particular through inevitable air admission when the storage vessel is changed, which can lead to decomposition of residues of the liquid substance in the supply line, especially since the substances, usually organic metal or semimetal compounds, are often extremely sensitive to air and/or moisture.

In order to eliminate the impurities one has previously cleaned the line connecting the rising line with the device and the pressure gas line for pressurizing the substance in the storage vessel by evacuating the particular line with a vacuum pump and then drawing in a solvent from a solvent vessel after changing the storage vessel, the solvent then being emptied into a waste vessel. This flushing process is generally performed several times. This cleaning procedure requires carefully working, reliable operators, is time-consuming (e.g. one must monitor the levels of the solvent vessel and waste vessel for spent solvent and the vacuum), and rather elaborate because of the additional solvent vessel and waste vessel for spent solvent.

SUMMARY OF THE INVENTION

The object of the invention is therefore to provide an easily handled, reliable device for cleaning the connecting pieces and lines of a storage vessel, such as the type described above.

This is obtained according to the invention with a storage vessel for liquid high-purity substances having an integrated device for cleaning the connecting pieces and lines of the storage vessel. Advantageous embodiments of the inventive storage vessel are disclosed.

That is, according to the invention the storage vessel is formed as a package together with the solvent vessel and/or an evacuated vessel serving as a vacuum source for the flushing process.

Further, one can provide a waste vessel for the spent solvent used for flushing. This vessel can also be combined with the evacuated vessel. The storage vessel can thus form a package with one, two or three further vessels, being replaced as a whole by a new package when the storage vessel is changed.

This considerably simplifies logistics while at the same time considerably reducing the possibility of operating errors. For example the solvent vessel, the vessel for receiving spent solvent and the evacuated vessel can be designed in such a way that sufficient solvent, capacity for used solvent and vacuum are always available for flushing when the storage vessel is changed.

In the simplest case, the package may comprise only one vessel for solvent in addition to the storage vessel for the liquid substance. The vacuum for cleaning the connecting pieces can then be produced by a vacuum pump for example, and for receiving spent solvent one may provide a waste vessel independent of the package.

It is also possible to provide a package with only an evacuated vessel as a vacuum source for flushing the connecting pieces together with the storage vessel, or a package only with the waste vessel for used solvent in addition to the storage vessel.

However, along with the storage vessel, the package preferably comprises both a solvent vessel and an evacuated vessel as a vacuum source which may at the same time form the vessel for receiving used solvent.

The vessel for solvent, the evacuated vessel and a separate waste vessel for spent solvent, if present with the evacuated vessel, can be combined into a package with the storage vessel in a great variety of ways. For example, the vessels can be disposed beside, below or within the storage vessel for the liquid substance. Several vessels for solvent, the vacuum and/or for used solvent can be provided. The vessels can be formed by double or multiple jackets around the main vessel. However, they always form a package together with the storage vessel which can be used for transport and for stockpiling.

The evacuated vessel can contain a solid absorbent, for example a molecular sieve, e.g. a zeolite. The absorbent is provided for maintaining the vacuum in the evacuated vessel, i.e. to adsorb air penetrating the evacuated vessel through leaks. When the evacuated vessel receives spent solvent, the absorbent serves to absorb the solvent. The properties of the absorbent are thus adapted to the solvent. That is, with hydrophobic solvents, such as hexane, one uses a hydrophobic absorbent and with hydrophilic solvents, for example ethanol, one uses a hydrophilic adsorbent.

The solvent vessel, the evacuated vessel and, if present, the vessel for spent solvent are adapted to be connected via a shut-off device to the connecting piece of the pressure gas line and the rising line, preferably between the coupling and the shut-off device of the pressure gas line or between the coupling and the shut-off device of the rising line. The shut-off devices may be valves, cocks or the like. Preferably, the connecting piece of the pressure gas line to the storage vessel is connected with the connecting piece of the rising line by a connecting line with a shut-off device.

The shut-off devices in the connecting pieces of the pressure gas line and the rising line and the shut-off devices connecting the solvent vessel, the evacuated vessel and, if present, the vessel for spent solvent to the connecting pieces of the pressure gas line and the rising line are preferably connected to a plate provided with channels having connected thereto, besides the rising line, the connecting pieces for the pressure gas line and the rising line as well as optionally a port for supplying pressure gas to the storage vessel. A further channel in the plate can be formed by the connecting line interconnecting the connecting pieces for the pressure gas line and the rising line.

Such a plate with attached shut-off valves, which are also designated "surface mounted devices," is characterized by short channels and thus small dead volumes, a better seal and simple mounting because e.g. the shut-off devices need only be screwed into corresponding tapholes with a seal in the plate. The connecting pieces and optionally the couplings for the pressure gas line and the rising line can likewise be integrated in the plate.

The shut-off devices in the connecting pieces of the pressure gas line and the rising line as well as the shut-off devices connecting the solvent vessel, the evacuated vessel and/or the vessel for spent solvent to the connecting pieces of the pressure gas line and the rising line are preferably formed so as to be automatically operable. For automatic operation, the shut-off devices can be formed so as to be operable pneumatically or electrically.

Preferably, a control unit is provided for driving the shut-off devices in such away that the cleaning process takes place automatically after the package with the storage vessel is changed.

If the shut-off devices are driven by an external control unit via electric control lines, it is advantageous to connect the control line from the shut-off devices with a plug, socket or similar plug-type part to be fitted with a mating part for connection with the control unit. This prevents errors from occurring when the control line is connected with the control unit after a change of package. The plug-type part can at the same time connect the level measuring device in the storage vessel with the level indicator.

BRIEF DESCRIPTION OF THE DRAWINGS

In the following the invention will be explained in more detail by way of example with reference to the drawings, in which.

DETAILED DESCRIPTION

Figure 1:
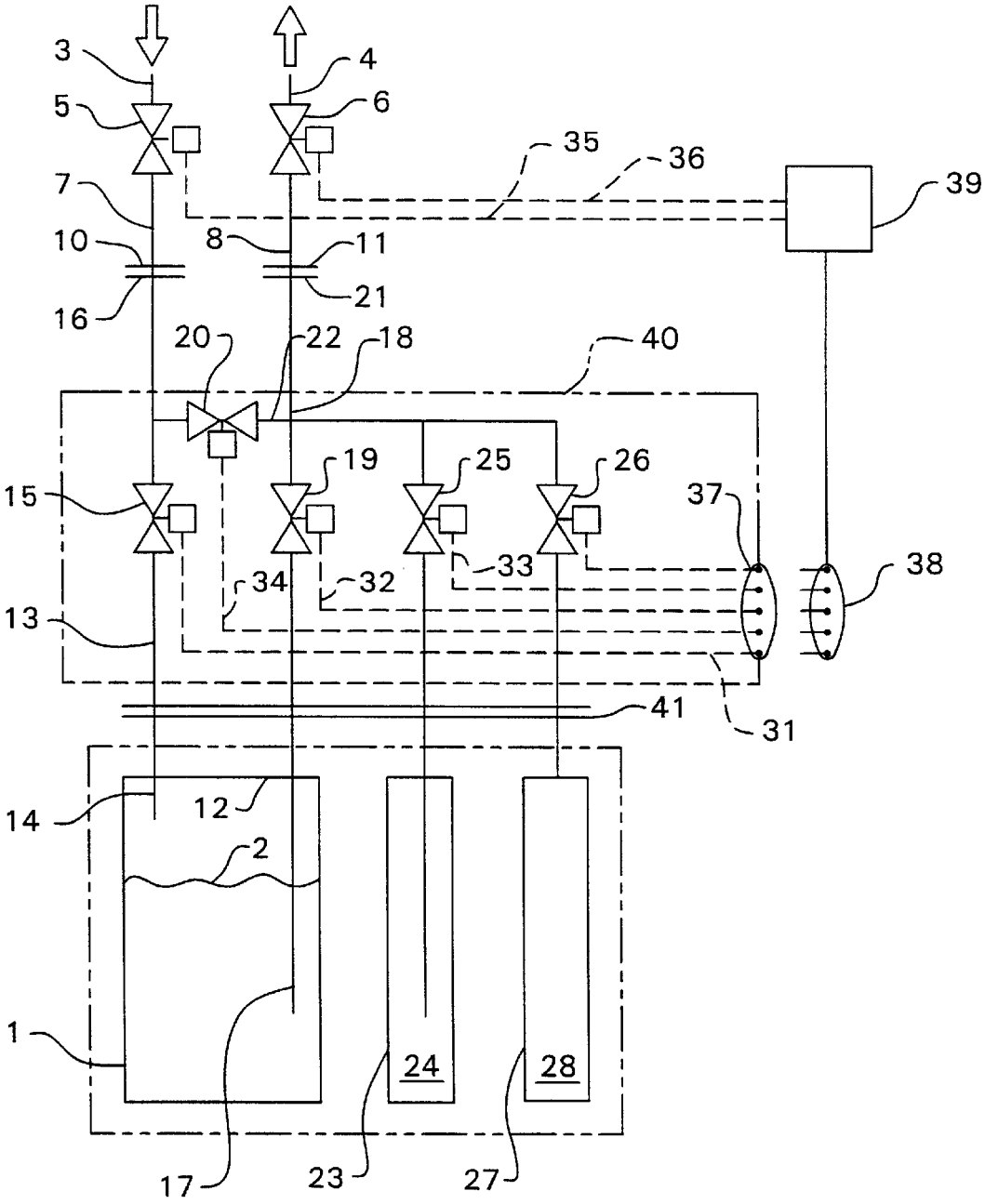
FIG. 1 is a schematic view of a package with a storage vessel and a vessel for solvent and a vessel as a vacuum source and for receiving spent solvent.

In accordance with FIG. 1, a storage vessel 1 filled with a liquid substance up to level 2 is connected to a pressure gas line 3 and a discharge line 4 leading to an end-use device, for example a CVD reactor.

Pressure gas line 3 and line 4 have valves 5, 6, respectively, whereby in particular valve 6 in line 4 can also be provided on a manifold supplying the liquid substance to a plurality of end-use devices. Valves 5, 6 are connected to couplings 10, 11 via connecting pieces 7, 8.

To subject liquid substance 2 in the interior of storage vessel 1 to the pressure of pressure line 3, connecting piece 13 is provided on a cover 12 of vessel. The connecting piece 13 opens into vessel 1 above substance 2 e.g. via a port 14 and having a valve 15 and a coupling 16 which are connected with coupling 10. To supply liquid 2 in storage vessel 1, which is pressurized by pressure gas supplied via connecting piece 13, to line 4 to the end-use device, a discharge line protrudes into the lower part of cover 1 and formed as a rising line 17 is provided on cover 12 and connected with a connecting piece 18 provided with a valve 19 and a coupling 21 for connection with coupling 11. Interconnectable couplings 10, 16 and 11, 21 can be formed by conventional connection fittings for gas lines.

The two connecting pieces 13 and 18 are connected with a valve 20 by a connecting line 22. Connected to connecting piece 18 via a valve 25 is a vessel 23 for solvent 24. A vessel 27, which is evacuated and contains solid absorbent 28, is connected to connecting piece 18 via a valve 26. The connection of vessels 23 and/or 27 can also be effected to connecting piece 13 and/or connecting line 22.

Figure 2:
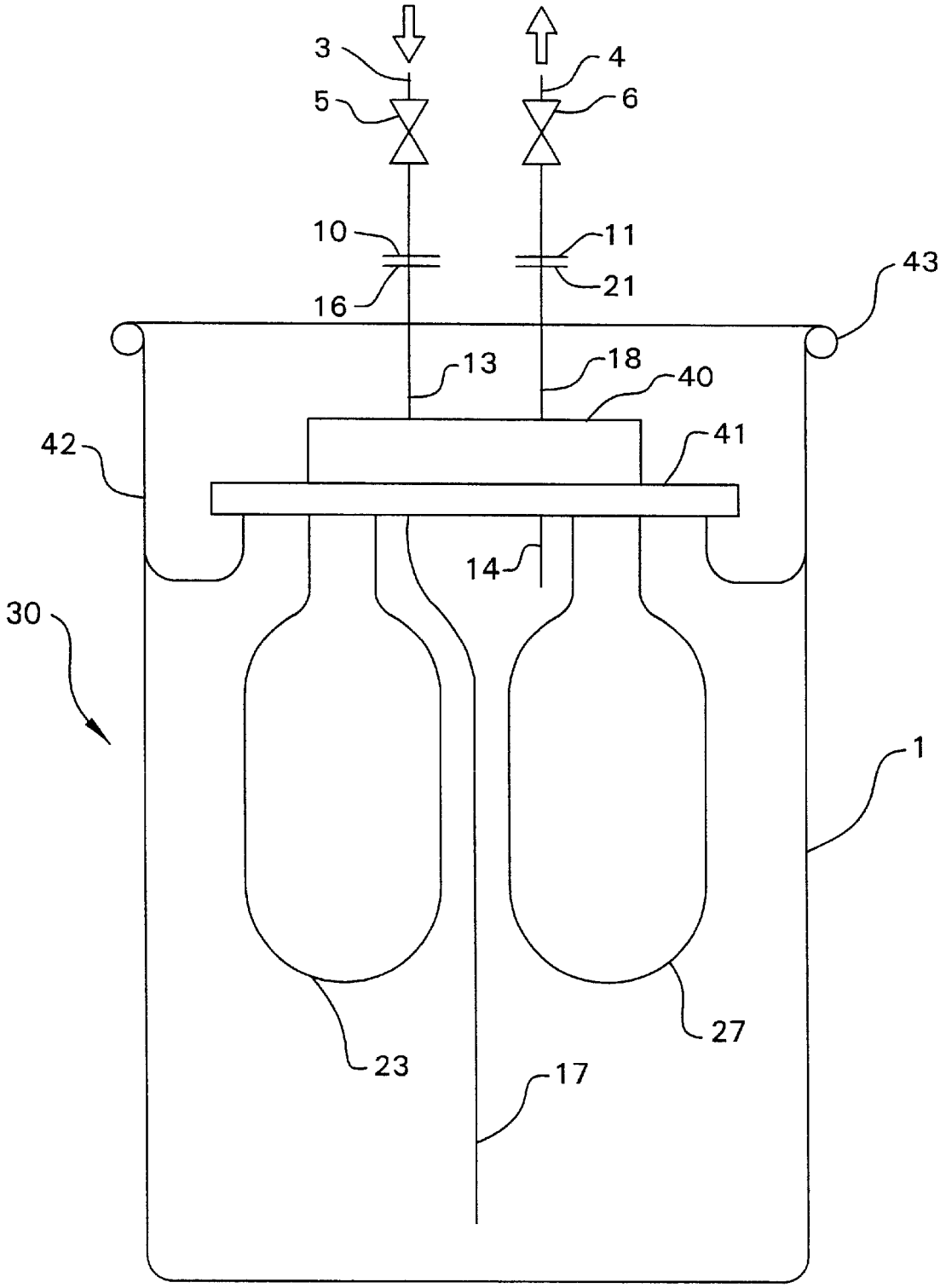
FIG. 2 shows schematically a section through a package comprising the storage vessel and the vessels disposed in the storage vessel for solvent or as a vacuum source and for receiving spent solvent.

Vessels 23 and 27 form a package 30 together with storage vessel 1 (FIG. 2). A new package 30 is delivered with closed valves 15, 19, 20, 25 and 26. Valves 5 and 6 are closed before removal of the previously connected package. To clean air-filled connecting pieces 7, 8, 13 and 18 after connection of couplings 10, 16 and 11, 21 one first opens valves 20 and 26 to evacuate connecting pieces 7, 8, 13, 18, including connecting line 22 and the further lines from connecting piece 18 to valves 25, 26. Then one closes valve 26 and opens valve 25, this causes solvent 24 to flow from vessel 23 into connecting pieces 7, 8, 13, 18 and connecting line 22. After valve 25 is closed, valve 26 is again opened so that solvent in connecting pieces 7, 8, 13, 18 and connecting line 22 is drawn into the low pressure vessel 27 and absorbed by absorbent 28 contained therein. This process can be repeated several times.

To perform the process automatically, valves 15, 19, 20, 25 and 26 are operable automatically, i.e. for example pneumatically or electrically, via electric control lines 31 to 34 which are adapted to be connected with a control unit 39 via a plug connection comprising plug-type parts 37, 38. Valves 5 and 6 of connecting pieces 7, 8, are operable by control unit 39 via control lines 35, 36. At the end of the cleaning treatment, valves 20, 25 and 26 are closed. Then valves 5, 15 and 6, 19 can be opened to supply the liquid substance to the consumer via line 4 under pressure gas.

In accordance with FIG. 2, the portion 40 of the device framed by a dash-dotted line in FIG. 1 can be integrated as a surface mounted device on a plate 41 which at the same time closes storage vessel 1. Vessel 23 for solvent and evacuated vessel 27 are disposed in the interior of storage vessel 1. It is evident that connecting pieces 7, 8, 13 and 18 can also be formed by bores in flange 41 or integrated in valves 5, 6, 15 and 19, and likewise couplings 10, 11, 16 and 21. Also, connecting line 20 can be provided between connections 7 and 8.

To protect the cover or plate 41, vessel 1 has a hoop-shaped extension 42 with a border 43 to permit a protective cover to be fastened e.g. with a straining ring.

Figure 3:
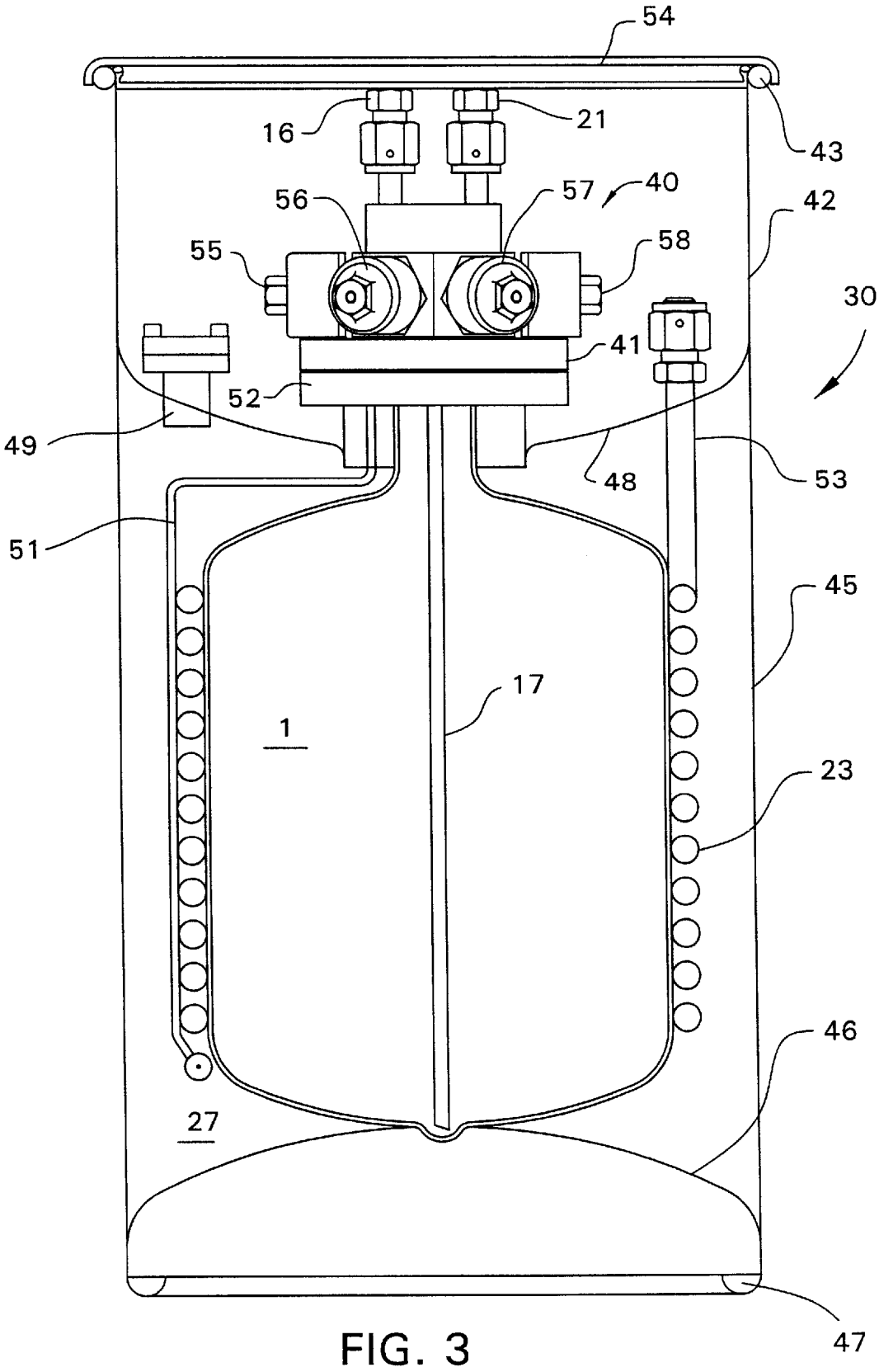
FIG. 3 shows a section through one embodiment of the package of FIG. 2.

In accordance with FIG. 2, package 30 according to FIG. 3 is also formed as a barrel with a circumferential wall 45, an inwardly curved bottom 46 with an annular foot 47 and a partition 48. Partition 48 is followed by extension 42 with border 43.

Storage vessel 1 with rising or discharge line 17 is disposed in the interior of barrel 30 concentrically to circumferential wall 45, being supported on bottom 46. The space between circumferential wall 45, bottom 46, partition 48 and storage vessel 1 is evacuated and forms vessel 27 for spent solvent; it may also be filled with solid absorbent, for example zeolite. Since spent solvent is thus absorbed, the fire hazard is reduced if e.g. circumferential wall 45 is damaged. Likewise, liquid substance 2 in vessel 1 is absorbed if vessel 1 is damaged, thereby considerably increasing the safety of package 30. A connecting piece 49 connecting vessel 27 with valve 26 (FIG. 1) is provided in partition 48. Solvent vessel 23 is formed by a pipe coil disposed around storage vessel 1 in space 27. Alternatively, a ring or hollow cylinder around storage vessel 1 can also form the solvent vessel.

Couplings 16, 21 and surface mounted device 40 are disposed in extension 42. Surface mounted device 40 is located on flange 41 connected with a flange 52 on storage vessel 1. A line 51 connecting solvent vessel 23 with valve 25 (FIG. 1) in the surface mounted device is connected to the lower end of solvent vessel 23 which is filled via a connecting piece 53 penetrating partition 48. A cover 54 on border 43 closes off package 30 at the top. Further, FIG. 3 shows some of actuators 55–58 for actuating valves 15, 19, 20, 25 and 26 (FIG. 1).

I claim:

1. A storage assembly for connection to an end-use device, said assembly including:

a storage vessel for containing a liquid that is supplied to the end-use device;

a first connecting piece that extends from said storage vessel, a first coupling that is attached to said first connecting piece for removably coupling said first connecting piece to an outlet connector of a pressurized gas line and a first shut-off device attached to said first connecting piece for regulating fluid flow in said first connecting piece;

a second connecting piece that extends from said storage vessel, a second coupling that is attached to said second connecting piece for removably coupling said second connecting piece to an inlet connecting piece of the device and a second shut-off device attached to said second connecting piece for regulating fluid flow in said second connecting piece;

a solvent vessel for containing a solvent;

a third connecting piece extending from said solvent vessel to said first and second connecting pieces;

a containment vessel for receiving spent solvent;

a fourth connecting piece extending from said containment vessel to said first, second and third connecting pieces;

an evacuation vessel integrally attached to said containment vessel, said evacuation vessel configured to function as a vacuum source and to be selectively connected to said containment vessel so that connection of said evaluation vessel to said containment vessel results in said containment vessel being in a low pressure state so spent solvent is drawn from said first, second, third and fourth connecting pieces, the outlet connector of a pressurized gas line and the inlet connecting piece of the device wherein, at least one of said solvent vessel or said evacuation vessel is attached to said storage vessel to form an integrated package with said storage vessel.

2. The storage assembly of claim 1, wherein said containment vessel forms said package with said storage vessel.

3. The storage assembly according to claim 1, wherein said containment vessel is adapted to function as the vacuum source so that said containment vessel functions as said evacuation vessel.

4. The storage assembly according to claim 1, wherein the evacuation vessel contains a solid absorbent.

5. The storage assembly according to claim 1, wherein a connecting line extends between the first connecting piece and the second connecting piece and a connecting line shut-off device is attached to the connecting line.

6. The storage assembly according to claim 1, wherein said storage vessel is disposed in an interior of a barrel, and a space between the storage vessel and a circumferential wall of the barrel forms the containment vessel.

7. The storage assembly according to claim 6, where the solvent vessel is disposed around the storage vessel in the space between the storage vessel and the circumferential wall.

8. The storage assembly according to claim 1, wherein:

a third shut-off device is attached to said third connecting piece for regulating fluid flow in said third connecting piece;

a fourth shut-off device is attached to said fourth connecting piece for regulating fluid flow in said fourth connecting piece;

a connecting line fluidly connects said first connecting piece to said second connecting piece, a fifth shut-off device being attached to said connecting line for regulating fluid flow in said connecting line; and said first, second, third, fourth and fifth shut-off devices are automatically operable via a plurality of control lines.

9. The storage assembly according to claim 8, wherein the plurality of control lines and from the first, second, third, fourth and fifth shut-off devices are connected with a plug-type part configured for fitting with a mating part for connection with a control unit.

10. The storage assembly according to claim 9, wherein the plug-type part is a quick coupling.

11. The storage assembly according to claim 9, wherein the storage vessel contains a level measuring device including a line connected to the plug-type part to connect the level measuring device with a level indicator.

12. The storage assembly according to claim 1, wherein:

a third shut-off device is attached to said third connecting piece for regulating flow between said third connecting piece and said first and second connecting pieces; and a fourth shut-off device is attached to said fourth connecting piece for regulating flow between said fourth connecting piece and said first and second connecting pieces.

13. The storage assembly according to claim 1, wherein:

a third shut-off device is attached to said third connecting piece for regulating fluid flow in said third connecting piece;

a fourth shut-off device isattached to said fourth connecting piece for regulating fluid flow in said fourth connecting piece;

a connecting line fluidly connects said first connecting piece to said second connecting piece;

at least one of the first, second, third and fourth shut-off devices being connected to a plate, wherein the plate has a number of channels configured for at least one of connecting the first and second connecting pieces to an interior of the storage vessel and the discharge line and forming the connecting line.

14. The storage vessel according to claim 13, wherein the plate closes an opening of the storage vessel.

* * * * *